United States Patent [19]

Jackson, Jr.

[11] Patent Number: 5,005,315

[45] Date of Patent: Apr. 9, 1991

[54] MULTI-PANEL SLIDING CLOSURE UNIT

[76] Inventor: Arthur J. Jackson, Jr., 6310 Barrister Place, Alexandria, Va. 22307

[21] Appl. No.: 522,031

[22] Filed: May 11, 1990

[51] Int. Cl.[5] ..... E05D 15/26

[52] U.S. Cl. ..... 49/127; 49/128; 49/365; 52/64; 52/243.1

[58] Field of Search ..... 49/127, 125, 128, 129, 49/130, 365; 52/64, 243.1, 238.1, 780, 207

[56] References Cited

U.S. PATENT DOCUMENTS

| | | | |
|---|---|---|---|
| 2,107,624 | 2/1938 | Berger | 52/780 |
| 2,979,786 | 4/1961 | Beauchamp | 49/365 |
| 3,291,119 | 12/1966 | Jones, Jr. | 49/125 X |
| 3,425,160 | 2/1969 | Petterborg | 49/127 |
| 3,447,274 | 6/1969 | Davidson | 52/238.1 X |
| 3,816,964 | 6/1974 | Catalano | 49/127 |
| 4,642,947 | 2/1987 | Dickson | 49/127 X |

*Primary Examiner*—Philip C. Kannan

*Attorney, Agent, or Firm*—Stevens, Davis, Miller & Mosher

[57] ABSTRACT

A multi-panel sliding closure unit having a plurality of slidable panels such as doors or insect screen panels are used to close a large opening in a building wall such as an opening facing out onto a patio or deck. Adjacent panels stand in edge-to-edge relationship but between adjacent panels is a vertical jamb post of H shaped cross-section into which the panels fit, holding them securely on their vertical edges. The jamb posts each fit snugly between a pair of upper and lower tracks that also hold the horizontal edge of the panels for sliding movement therealong. At one end of the tracks is a laterally movable storage module for storing panels slid therein from the tracks.

13 Claims, 4 Drawing Sheets

MULTI-PANEL SLIDING CLOSURE UNIT

This invention pertains to a multi-panel sliding closure unit such as a series of doors that are mounted for sliding movement to close a wide opening in a wall of a building. The unit of this invention could be used either as a room divider, for example to divide a large meeting hall into a series of smaller rooms, or, more preferably to close off an opening in the outer wall of a building, such as a wide door opening out onto a deck, veranda or patio.

In such a wide opening in a building outer wall it may be desirable during warm and pleasant weather to have the entire opening completely open or covered only with open mesh screen panels. In cold weather it is desirable to have the opening completely covered with imperforate panels such as glass or wood doors. In areas subject to violent weather, such as hurricanes, it is desirable to be able quickly to cover the entire opening with storm tight panels such as heavy sheets of plywood. The present invention makes it possible to use any one of the desired closure panels or any combination thereof.

THE PRIOR ART

There have been numerous attempts in the prior art to accomplish closures of wide wall opening. U.S. Pat. No. 3,425,160 to Petterborg shows a plurality of panels suspended in edge-to-edge relationship from an upper track. A supporting carriage is mounted at one end of the track for lateral movement to bring various panels into alignment with the end of the track so that the panels can then be slid off the supporting carriage and along the overhead track which extends across the top of the opening.

U.S. Pat. No. 3,816,964 to Catalano discloses individual panels that are mounted for sliding horizontal movement between upper and lower tracks, a storage unit at one end of the track receives the panels when slid therein but that storage unit is not moveable in relation to the track, the panels are instead moved sideways and into the stationary storage unit. The panels therefor must always be kept in the same relative position to each other.

ADVANTAGES OF THE PRESENT INVENTION

The prior art closures have proved to be expensive and difficult to install. More importantly the moveable panels, when in place on the track, are at best supported at their top and bottom edges but the vertical side edges of the panels do not have support along their length, leading to an installation that offers poor security against intruders and is prone to leak air and thus be wasteful of heating or cooling in the building in which the unit is placed.

The present invention overcomes these disadvantages by use of a plurality of individual removable jamb posts that closely interfit between the upper and lower tracks and provide a strong frame on both vertical sides of a panel. The jamb posts are preferably of H shape in cross-section and have a means, such as a vertically extendable barrel bolt type lock, to engage with at least one of the upper or lower tracks, and preferably with both, so that the vertical side edge of each closure panel can fit into one open end of the "H" cross-section and thus be supported along its entire length.

BRIEF DESCRIPTION OF THE DRAWINGS

Other objectives and advantages will become apparent from the attached drawings which show, by way of example only a preferred embodiment of the invention as presently contemplated in which.

DETAILED DESCRIPTION

Figure 1:
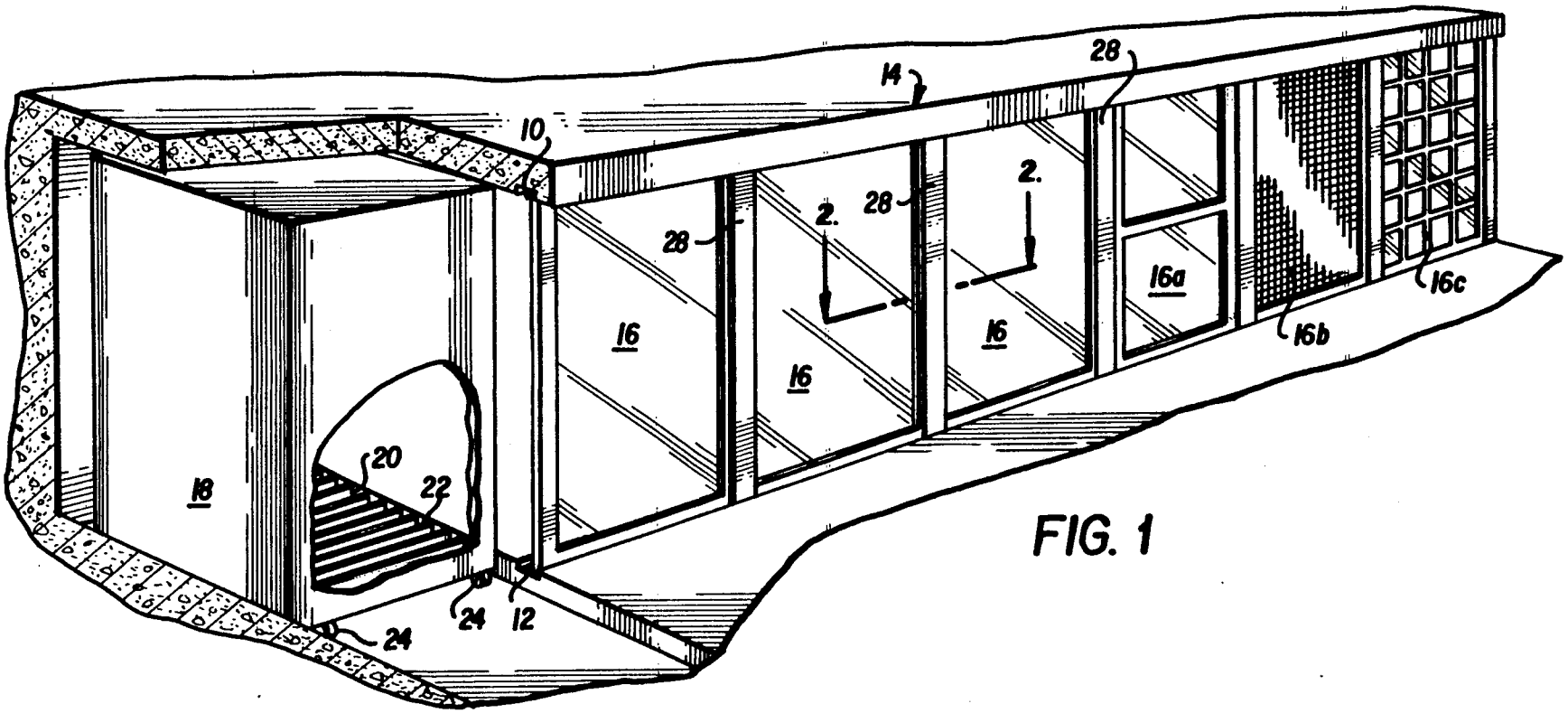
FIG. 1 is a perspective view, partly broken away, of a closure unit according to this invention.

Turning now to FIG. 1 there is shown an upper track 10 and a lower track 12 secured respectively to the upper and lower edges of an opening 14 in a building structure. The tracks would preferably be recessed into the ceiling and floor as shown in FIG. 1. The opening 14 may, for example, be a facing out onto a deck, veranda or patio.

The upper and lower track structure may each be of a "U" shape in cross-section to define a single grove for sliding of a closure panel but preferably would be of at least an "E" shape in cross-section so as to define two adjacent tracks. In other cases the track structure would be shaped to define three adjacent tracks. The three track installation is of advantage where one wishes to have a pair of sliding doors with a screen door associated with at least one of the sliding door. In a three track installation there would, of course, be a jamb post that would also have three grooves and preferable lockable into two or three of each of the upper and lower tracks. In any case the track structures would preferably be made of metal such as extruded aluminum.

The weight of the closure panels may be carried by any convenient conventional means such as rollers engaging a rail in the upper track structure or rollers on the bottom of the closure panels to engage the lower track structure. In any case each of the closure panels should be capable of sliding the entire length of the track structure and into the storage module 18 at the end of the tracks.

Figure 5:
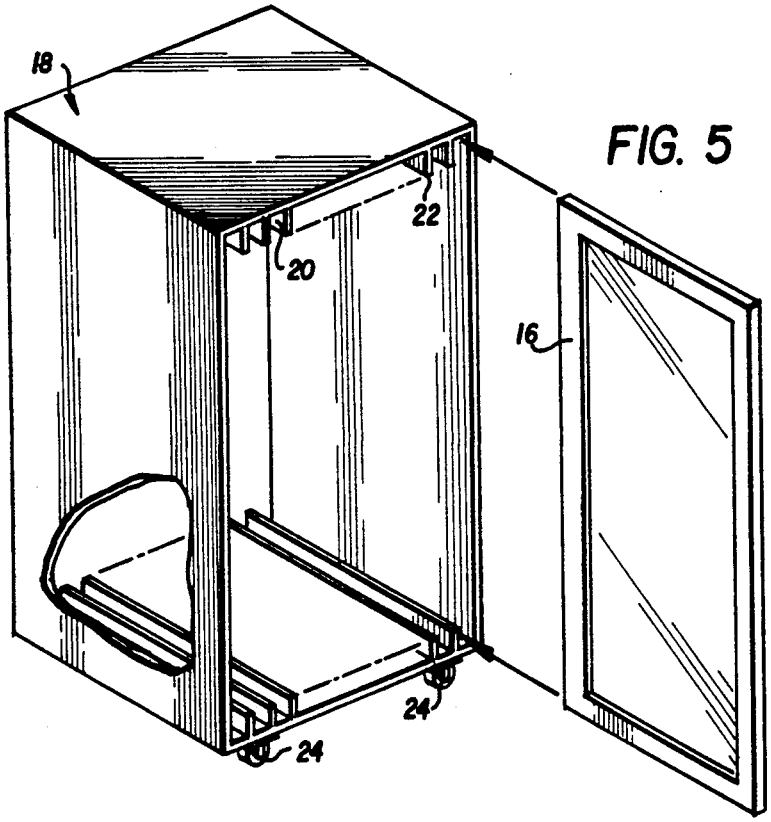
FIG. 5 is a perspective view of the storage module that is shown on the left side of FIG. 1, illustrating the placing of one closure panel therein.

The storage module 18, as best seen in FIG. 5, has a plurality of partitions 22 defining a plurality of grooves 20 on the upper and lower interior surfaces of the module. The grooves are of a width to permit a closure panel to be easily slid therein. The pairs of upper and lower grooves are in vertical alignment so as to permit a closure panel 16, as shown in FIG. 5, to be slid into the storage module. The number of pairs of upper and lower grooves may be one greater than the number of closure panels and in some embodiment the number of pairs of grooves would be twice that of the number of closure panels. However, the invention operates satisfactorily if the number of pairs of grooves is equal to the number of panels required to close the opening. Of course if one did not want the capability of having the wall opening to be completely open, then the number of pairs of grooves can be fewer than the number of closure panels.

The storage module is mounted for lateral movement in relation to the tracks 10 and 12, for example by means of castors 24 or by mounting the storage module on its own secondary tracks, said secondary tracks being perpendicular to the tracks 10 and 12. Castor mountings of the storage module would be of advantage in installations where the storage module is to be moved away from its normal position as shown in FIG. 1 to a remote location for storage of certain types of closure panels that would not be used on a seasonal basis, i.e., screen panels in the winter, storm door panels in the summer or hurricane protection panels for most of the year. In such an instance there would be at least two separate storage modules used on an interchangeable basis.

Castors or a turntable or a curved secondary track can also be used to move the storage module to face in a different orientation, for example turned by 90° so as to take up less space in a room where it is located.

Alternatively a single storage module could be built with a sufficient number of pairs of slots to hold all of the panels (perhaps three sets—glass, screen and storm protection) that might be needed in a particular location. The choice of modules would depend upon the amount of space available for a single large module, the distance to a remote location, the length of time that a particular set of closure panels is to be used, etc. The invention of the present system permits a wide degree of flexibility in the type of storage module to be used.

As previously mentioned, it is preferable that each storage module 18 have a number of pairs of upper and lower slots 20 that is one greater than the number of closure panels.

Such a storage module configuration permits closure panels to be "shuffled" to change types of panels. By way of example let us suppose that a building has an 18 foot wide opening facing out onto a patio with an "E" shaped upper and lower track structure 10 and 12 having inner and outer grooves. The inner track has six glass closure panels, each three feet wide, completely covering the opening and the user wants to change over to a mixture of two glass panels and four of the six screen panels that are stored in the module. The module would have a seventh slot, initially empty. The first glass panel (closest to the storage module) is slid into the empty seventh slot, the module is shifted laterally to align a screen panel with the outer track and that screen panel is then slid down the outer track. The next panel in the outer track can then be either the glass panel previously put into the module or another screen panel; depending upon the user's choice the storage module is shifted laterally to align the panel desired to be inserted in the next position on the outer track. The process of shifting the module and sliding out the desired panel is repeated until all of the panels in the desired order have been slid out of the module and down the outer track. As empty spaces appear in the module they can be filled by glass panels being slid from the inner track into the module. Those glass panels can then either be kept in the module for storage or immediately transferred to the outer track by appropriate lateral shifting of the storage module.

Of course if it is desired to have the building opening 14 completely open and all panels removed then it is necessary to have a storage module with a sufficient number of pairs of slots to hold all panels (12 slots in the example above) or to have a module that can be moved to a remote location to carry away panels that are temporarily not needed.

Figure 2:
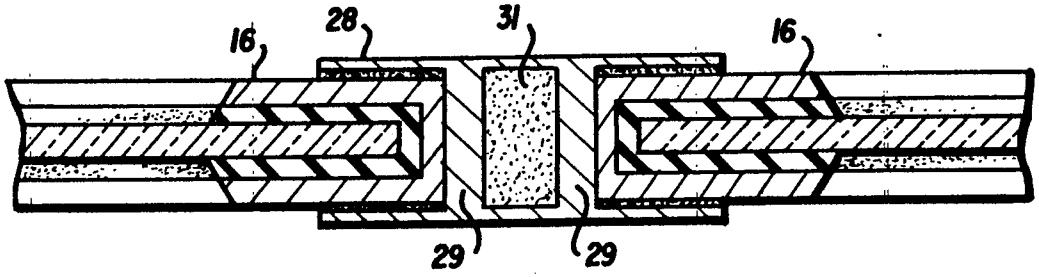
FIG. 2 is a cross-sectional view taken along line 2—2 in FIG. 1 of one of the vertical upstanding jamb posts of the invention.
Figure 3:
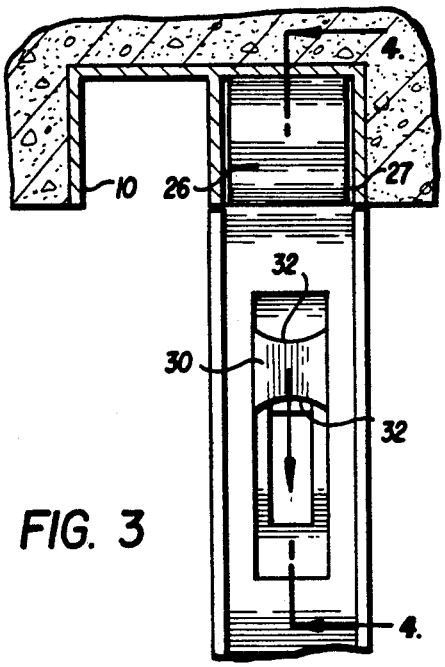
FIG. 3 is a cross-sectional view of the upper track showing a jamb post positioned thereunder.
Figure 4:
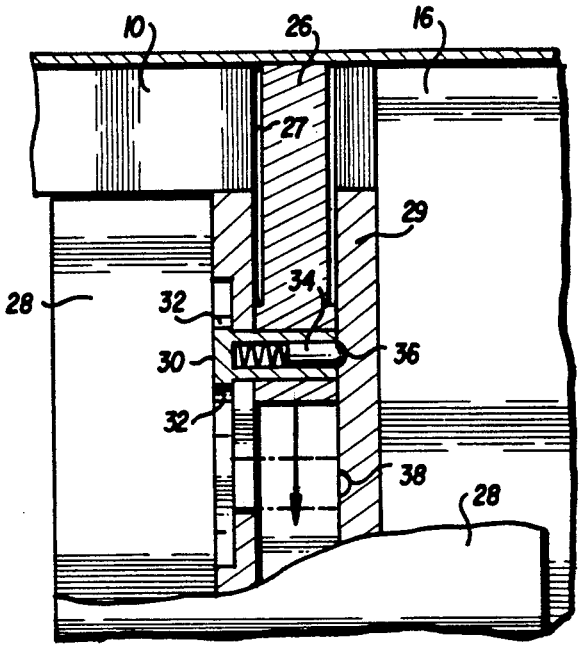
FIG. 4 is a cross-sectional view along line 4—4 of FIG. 3 showing the interior construction of a mechanism for locking the jamb post to the upper track.

An important aspect of the present invention are the jamb posts 28 that are placed in a vertical upstanding position between adjacent closure panels 16. These posts are of a length to interfit closely between the upper and lower track structures. At one end of each jamb post and preferably at both ends is vertically extendable bolt 26. As can best be seen in FIG. 2, the jamb posts are of "H" shape having a double center bar 29 defining closed rectangular space that is filled with insulation 31 in its central vertical position and acts as an enclosure at its end for bolt 26 as shown in FIGS. 3 and 4. The bolt 26 is moveable upward and downward by an actuator handle 30 having finger notches 32 for gripping it. Within the handle 30 is a spring loaded detent pin 34 having a rounded nose that can fit into an upper detent hole 36 when the bolt 26 is extended or a lower detent hole 38 when the bolt 26 is retracted. This is but one example of a suitable bolt actuating mechanism, a flip over handle actuator could also be used.

The vertically extendable bolt is designed to fit into an opening 27 in the track, such openings 27 to be spaced along the track at intervals corresponding to the width of the closure panels. The jamb posts are completely separable from the tracks and the closure panels so that when they are removed the opening in the building wall can be completely free of any structure. On the other hand when the jamb posts are in place they form a sturdy support along each vertical edge of each closure panel so as to make an air-tight joint that is also secure against unauthorized entry.

Figure 2A:
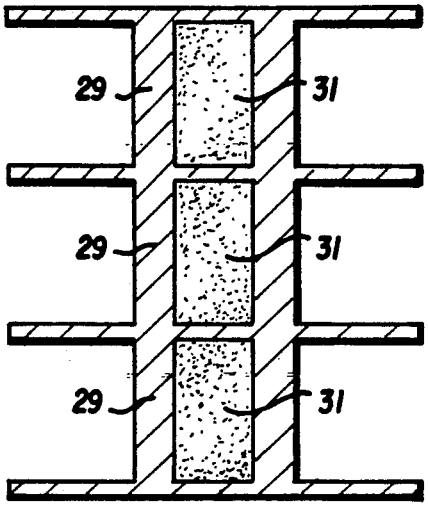
FIG. 2A is a cross-sectional view similar to FIG. 2 but of a triple jamb post.

FIG. 2A shows the cross-section of a jamb post for insertion between a triple upper and lower track structure. In this case there are three back-to-back H shaped members, each having a double center bar that defines a closed center rectangle. In the case of the double or triple jamb post each center rectangle can be equipped with a vertically extendable bolt 26 that goes into an opening in its respective track (inner or outer) so as to lock more securely the jamb post in place.

This invention also contemplates one or more swinging door units for use in the tracks. It is preferable that all sliding components be of a modular size, for example 36" wide. In the case of a swinging door unit there is a 36" wide frame around the door and a narrower door of say 32" or 30" is then hinged from the 36" door frame. That frame can of course be secured in place with the same jamb posts as are used for the other closure panels. In this manner once the jamb posts are removed the swinging door unit (frame and door hingedly mounted therein) can be slid in place along the track or stored in the storage module in the same manner as the other closure panels.

Figure 9:
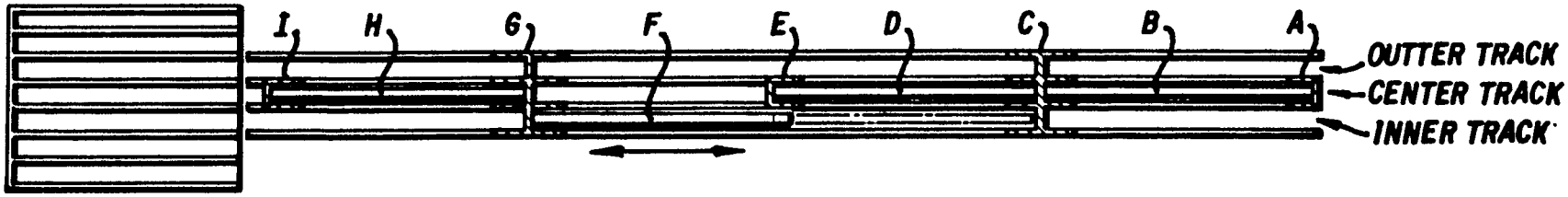
FIG. 9 is a diagrammatic plan view of three tracks and panels and jamb posts positioned thereon.

This invention includes the use of a sliding door that is separately operable despite the fact that the closure panels on each side thereof would be positioned to be stationary. In such a set-up on triple tracks (assuming four panels needed to close the opening) there could be, starting from the track end remote from the storage module, (a) a jamb post on the center track, (b) a fixed panel on the center track, (c) a jamb post (fitting upper and lower triple tracks), (d) a fixed panel on the center track, (e) a fixed jamb post in the center track, (f) one sliding door in the inner track, (g) a jamb post (fitting upper and lower triple tracks), (h) a fixed panel on the center track, and (i) the last jamb post I, if desired could have a key lock so that it could be locked in place, thus locking in all the rest of the closure panels. As shown in FIG. 9 wherein the tracks are shown as dashed lines, sliding door F, located on the inner track may be moved freely between jamb post C and G, sliding past fixed panel D and jamb post E. This is because jamb post E does not extend into the inner track.

If desired the outer track may be used for screens or other panels and in that case the screen or other panel may be slid between jamb post C and G in the same manner as door F because jamb post E is present only in the center track. The sliding door can, of course be placed anywhere along the length of the track.

Figure 6:
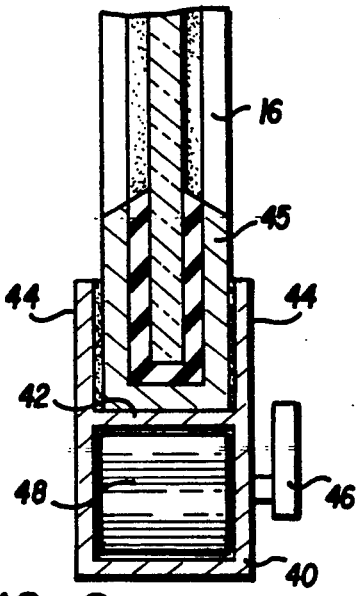
FIG. 6 is a top view showing a mechanism for locking a sliding door unit.
Figure 7:
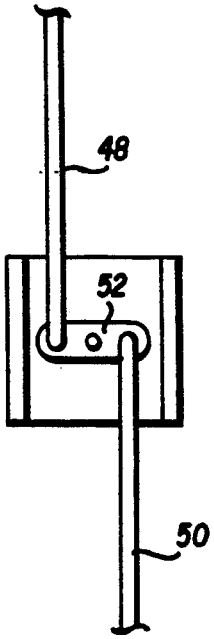
FIG. 7 is a rear view, partly in section, of the locking mechanism of FIG. 6.
Figure 8:
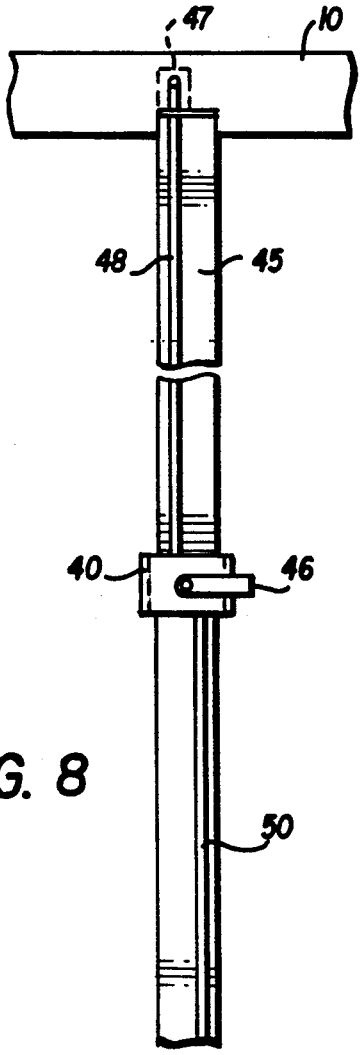
FIG. 8 is an elevational view of the locking mechanism of FIG. 6.

If such a sliding door is used, it can be locked in place by use of the special locking jamb post 45 as shown in FIGS. 6–8. This is a separate jamb post, not permanently attached to any panel, so it does not add to the thickness of the panel with which it is used since it can be removed before the panel is slid into the storage module.

The locking jamb post 45 has a body 40 having a channel 42 or "L" shaped opening on its rear face defined by one or two edges 44 that project outwardly therefrom. The channel is of a size to fit snuggly over one side member 45 of one of the panels 16. The locking jamb post 45 has a locking bolt or rod 48 extending lockwardly therefrom for vertical movement toward and away from at least one of the upper tracks 10 or lower tracks 12 with the bolt or rod 48 engaging, for example, upper track 10 in opening 47.

The sliding door has been described as being on the inner track so that the outer track can be reserved for a screen door or imperforate panels. If a sliding door as described above and in FIG. 9 is installed, then of course only a single screen door is needed. There would usually be a triple thickness jamb post on each side of the sliding door and thus a screen door between those jamb posts could seat in the outer groove of either jamb post.

It is also contemplated that a closure panel unit 16 could be partially closed and partially open, for example an imperforate lower portion and an upper portion having a window **16*a* (for example double hung or casement) so as to be separately openable after the closure unit is secured into place with the jamb posts in the usual manner. Thus this invention permits great flexibility to build-up the closure of a wall opening with screens 16*b*, storm doors (openable or not), sliding doors, window units 16*a* or imperforate storm protection panels 16*c*, examples of which are illustrated in FIG. 1**. The invention offers a high degree of security against forced entry because the closure panels cannot be pried out of their position between the tracks and the jamb posts as can happen with usual sliding door units. In such units the door must be shorter than the height of the opening since the end is not open and there is no other way of mounting the door. On the other hand in the present invention the closure panels can be slid in from the end and thus the panels are of the full height and cannot be pried out from between the tracks.

If desired the jamb posts, or only one of the jamb posts, can be equipped with a key operated vertically slidable bolt so as to prevent the jamb post nearest the storage module from being removed, thus locking in all of the closure panels and jamb posts.

Other modifications related to this invention are contemplated, all falling within the scope of the appended claims.

I claim:

1. A multi-panel sliding closure unit comprising:

an upper track extending across the top of a rectangular opening in a wall;

a lower track vertically under said upper track and similarly extending across the bottom of said rectangular opening in a wall;

a storage module at one end of said opening and means mounting said storage unit for lateral movement in relation to said upper and lower tracks;

a plurality of closure panels mounted for sliding movement along said upper and lower tracks, each closure panel having vertical side edges that are positioned to be in edge-to-edge alignment when said closures panels are slid out between said upper and lower tracks;

a plurality of storage positions in said storage module for serially receiving said closure panels as they are slid onto said storage module from said tracks;

a plurality of separate removable jamb posts positionable between facing vertical side edges of adjacent closure panels, said jamb posts being of a length to interfit between said upper and lower tracks and having a cross-sectional shape for interfitting with the vertical side edges of adjacent closure panels.

2. The unit of claim 1 in which the jamb posts have means for engaging at least one of said upper and lower tracks.

3. The unit of claim 2 in which the means for engaging is a vertically moveable bolt and one of said upper and lower tracks has means for receiving said bolt.

4. The unit of claim 1 in which the jamb posts are generally of H shape in cross section.

5. The unit of claim 1 in which there are a plurality of types of said closure panels selected from the group consisting of doors, windows, screens, security and storm protection panels.

6. The unit of claim 1 in which the number of storage positions in said storage module is greater than the number of closure panels required to extend across said opening so as to facilitate exchange of one type of closure panel for another type of closure panel by sliding a first type of panel off of said tracks and replacing them with a second type of closure panel from said storage module.

7. The unit of claim 1 in which said upper and lower tracks each have means for holding two separate series of closure panels in parallel alignment.

8. The unit of claim 7 in which at least one of said upper and lower tracks are arranged to be engaged by a separate jamb post.

9. The unit of claim 7 in which the means for holding two separate series of closure panels comprises an inner mounting means and an outer mounting means on both said upper and lower tracks.

10. The unit of claim 9 including jamb posts having means for engaging closure panels in both said inner and outer mounting means.

11. The unit of claim 1 including a locking mechanism for mountable upon one of said panels for securing said panel from sliding movement along said track.

12. The unit of claim 11 in which said locking mechanism has a body mountable upon one of said panels and a locking bolt extending outwardly therefrom for vertical movement toward and away from at least one of said upper and lower tracks.

13. The unit of claim 1 including a locking mechanism having a body shaped to interfit over a portion of one of the panels;

at least one locking rod extending outwardly from said body for engagement with one of said upper and lower tracks;

a handle mounted on said body and connected to said locking rod for vertically moving said locking rod for engagement with said track.

* * * * *